US006484986B1

(12) United States Patent
Kolodzieski

(10) Patent No.: US 6,484,986 B1
(45) Date of Patent: Nov. 26, 2002

(54) ADJUSTABLE ALL IN ONE ROOF BRACKET

(76) Inventor: Walter Kolodzieski, 3024 Jones St., Scranton, PA (US) 18505

( * ) Notice: Subject to any disclaimer, the term of this patent is extended or adjusted under 35 U.S.C. 154(b) by 0 days.

(21) Appl. No.: 09/859,365

(22) Filed: May 18, 2001

(51) Int. Cl.[7] ..... E04G 3/12
(52) U.S. Cl. ..... 248/237; 182/45
(58) Field of Search ..... 248/237, 148, 248/48.1, 536, 354.1, 354.3, 354.6, 357, 235, 241; 182/45, 200, 201, 202; 403/109.2, 109.3; D25/66, 68

(56) References Cited

U.S. PATENT DOCUMENTS 1,864,457 A * 6/1932 Nelson ..... 248/237
3,876,024 A * 4/1975 Shieman et al. ..... 180/19.1
4,884,775 A 12/1989 Fischer, Jr. ..... 248/237
4,957,185 A * 9/1990 Courchesne et al. ..... 182/150
5,165,642 A * 11/1992 Rihaly ..... 182/45
5,499,961 A * 3/1996 Mattox ..... 482/123
5,582,565 A * 12/1996 Soria ..... 482/141
5,771,992 A * 6/1998 Snyder ..... 182/200
5,860,370 A * 1/1999 Poniecki ..... 108/137
6,098,746 A * 8/2000 Castaneda ..... 182/3
6,105,718 A * 8/2000 Stewart ..... 182/100

* cited by examiner

*Primary Examiner*—Ramon O. Ramirez
*Assistant Examiner*—Jon Szumny
(74) *Attorney, Agent, or Firm*—Salzman & Levy

(57) ABSTRACT

An adjustable unitary roof bracket device having left and right secondary housings that can be extended or retracted with respect to the main housing or base. The secondary housings are adjustable in order to vary the overall length of the device which serves as extended planking while in its secured state.

8 Claims, 5 Drawing Sheets

ADJUSTABLE ALL IN ONE ROOF BRACKET

FIELD OF THE INVENTION

The present invention relates to roofing brackets and, more particularly, to an improved, safe, and unitary roofing bracket that eliminates the need for wooden planking commonly placed between separate, single steel roofing brackets.

BACKGROUND OF THE INVENTION

Roofing brackets have been found to be a necessity in construction, and the roofing industry in particular. Defined by law, such as safety standards set forth by O.S.H.A., any roof area comprising more than a 5/12 pitch (i.e., a five inch incline for one foot of linear run) is required to be scaffolded at the edge of the roof. The roof area itself must be bracketed and planked, with supporting roofing brackets spaced no more than four feet apart, the planks being laid securely between brackets. In building a home, for example, a framer will use this bracket and planking system to support himself or herself while sheeting over exposed roof rafters. A roofer often uses this same bracket and planking system to support himself or herself safely upon an area of roof while he or she applies tar paper and shingle.

Commercial roofing brackets, such as ones manufactured by AJC Tools and other manufacturers, are nailed securely onto a roof surface, thereby allowing for the placement of a chosen planking. Standard sized, 2 by 4's, 2 by 6's, and even 2 by 10's (dimensions given in width and depth of above wooden plankings) are commonly used and placed within direct contact with previously secured roof brackets. Lengths of wooden planking can vary from a scant few feet up to and exceeding twelve feet in length. With the roofing brackets and their planking now in place, a roofer can now use the bracket and planking system to keep oneself upright, and in a relative safe position with respect to the chosen area of workspace along the roof.

This conventional system of planking is presumed safe, so long as the wooden plankings themselves do not split or weaken, or even break entirely. The roofing brackets themselves, made of steel, are quite durable, but their success as a safety feature depends entirely on the strength and durability of the wooden planking that the aforementioned brackets support, as well as secure nailing. Through use, weathering and age, the bracket and planking system now in use can be crippled, or even fail entirely if any of the wooden planks placed within the holds of these brackets break or snap apart, or through the fault of its user, fail to secure each bracket securely. Only one bracket need fail for a planking to slip out of a secure position and cause its user to stumble or even fall from his or her perch. It is an opinion of many of its users, that this standard design practice can be improved upon.

The present invention is based on the discovery that it would be advantageous and safer to provide a complete, one unit roofing bracket system, so that the brackets and the user's safety are not solely dependent upon fallible wooden plankings.

The present invention features an adjustable roofing bracket wherein separate, secondary housings can be retracted or extended out from a center main housing, thus varying the overall length of the apparatus. Once a given length has been established, nailing tabs secure the apparatus upon the chosen, desired work surface.

DISCUSSION OF RELATED ART

In U.S. Pat. No. 4,884,775 issued to Karl Fischer on Dec. 5, 1989 for ADJUSTABLE ROOF BRACKET, an adjustable roof bracket constitutes three main parts: a main body part and two smaller arms, which together create a pivot point, thereby allowing the roofing bracket's angle in relation to its inclined work-space to be altered, creating a more receptive and comfortable angle for the addition of wood planking.

SUMMARY OF THE INVENTION

The present invention features an adjustable, unitary roofing bracket apparatus. The bracket comprises a main housing, into or out or which separate, secondary housings retract or extend from the main housing. Each secondary housing has a bearing track upon which it glides, retreating or extending itself a chosen distance in relation to the main housing. A nailing tab, the section of the bracket assembly used to secure the apparatus upon an inclined surface, is permanently affixed to each outward end of both secondary housings and extends or retracts along with the secondary housing, unless secured. A stationary nailing tab is permanently affixed to the center of the main housing as well.

Choosing a desired, extended length of the apparatus by extending or retracting both secondary housings, the location and position of the apparatus is secured by use of all three nailing tabs. Each nailing tab consists of a main body, comprising a flat, thin metal strip which extends away from the bottom end and rear of each section of housing it is attached to. An upper shoe plate, permanently attached to, and a part of the nailing tab assembly, is fitted with two slots, narrowed at their upper ends, receptive to the given size of a standard, #16 common nail.

It is common nails that secure the entire roofing aparatus bracketing device upon the inclined surface. By placing the shoe plate into its lowest position, closest to the base of its housing, after lightly securing the common nails, the narrowed slot of the shoe plate catches and secures the nails, thus securing the position of the nailing tab to its respective housing and thus to the entire roofing bracketing device. For added safety, a safety pin can then be placed in its receptive slot, thus preventing any accidental and undesired disturbance of the location of the nailing tab in relation to the area to which it is secured. By extending the secondary housings and securing each nailing tab to its respective surface area, the roofing bracket device in now ready to be utilized.

Another safety feature incorporated into this roofing bracket device is a locking pin, located within the top side of each secondary housing and approximately one inch from its inner end. If over-extended, the locking pin catches its mated hole at the top of the main housing and protrudes upward, thus preventing further extension of the secondary housing. To further advise the user, red-marked safe lines are drawn onto the exterior of the secondary housing, further warning the user to halt extension if safe lines become visible. The locking pins are spring loaded and can retreat back into the main housing body, thus allowing for the location of the secondary housing to be repositioned.

In its extended and secured position the roofing bracket system can now be utilized for its intended purpose, supporting an individual, and tools and material, so he or she can perform required tasks. In its envisioned and present form, metal alloy construction of this invention in its entirety has eliminated the need for wooden planking between each roofing brackets, since the main housing and both secondary housings replace the standard wooden plank.

It is an object of this invention to provide a more secure, safe and improved roofing bracket.

It is another object of this invention to provide an entirely self-contained roofing bracket system, thus eliminating the need for standard wooden plank or plankings.

It is another object of this invention to provide a roofing bracket that is adjustable in length in order to more adequately accommodate its user and not restrict the user to a predefined or fixed length of the equipment in use.

BRIEF DESCRIPTION OF THE DRAWINGS

A complete understanding of the present invention may be obtained by reference to the accompanying drawings, when considered in conjunction with the subsequent detailed description.

In which.

For the purpose of brevity and clarity, like elements and components shall bear the same designations and numbering throughout the Figures.

DETAILED DESCRIPTION OF THE PREFERRED EMBODIMENT

Generally speaking, this invention features an adjustable roofing bracket apparatus with secondary housings adjustably movable with respect to a main housing or base. The secondary housings are adjustable in order to vary the separation length between the secondary housings and its center, main housing to either lengthen or shorten the overall length of the apparatus.

Figure 1:
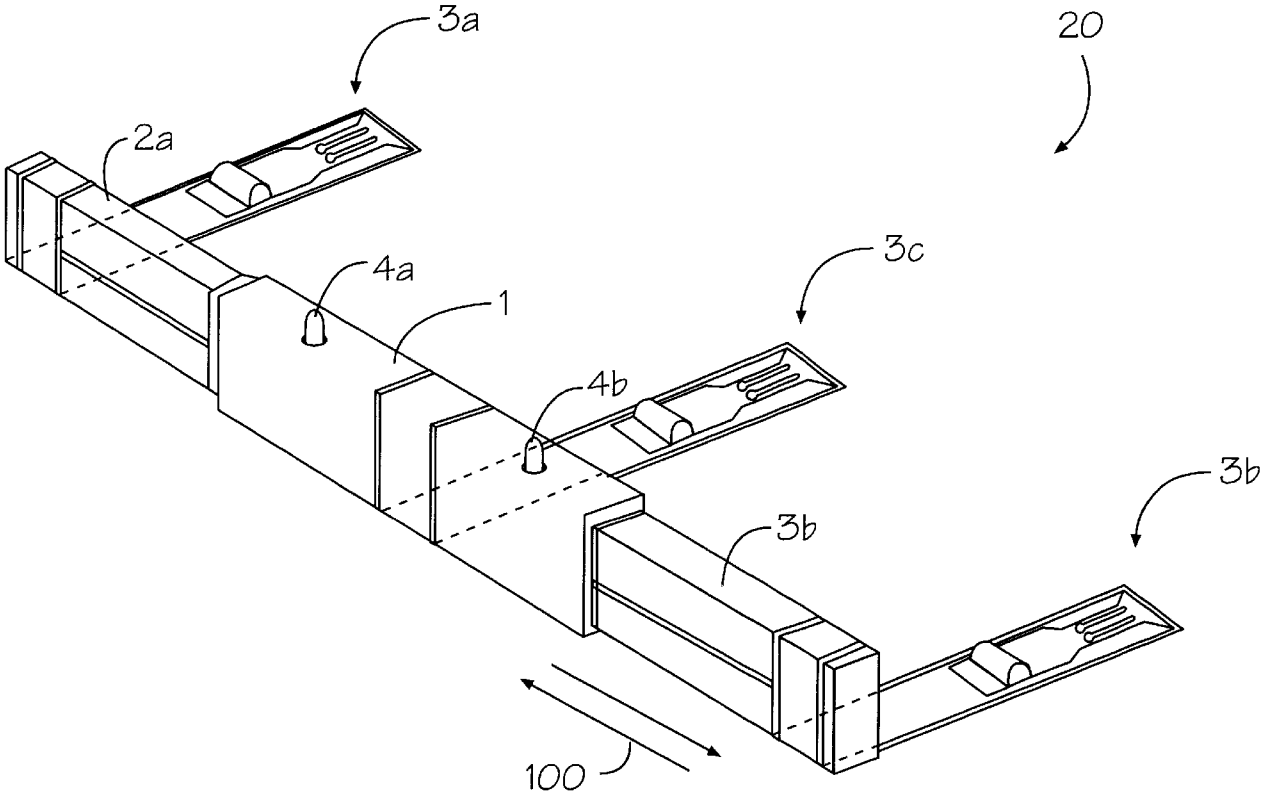
FIG. 1 illustrates a perspective view of the all in one roof bracket device of this invention.

Now referring to FIG. 1, there is shown a complete, all in one roofing bracket device 20 in accordance with this invention. The device 20 comprises a main housing 1 and two secondary housings 2*a* and 2*b*. Two identical nail tabs 3*a* and 3*b* are respectively attached to each secondary housing 2*a* and 2*b*, and a third nailing tab 3*c* is attached to a midportion of main housing 1. Secondary housing 2*a* and 2*b* can be manually retracted in the direction of arrows 100 within the main housing 1, thereby shortening the overall length of the device 20. This shorten length is useful for the device 20 in operation, and also provides a means of compacting the device 20 for transport or storage.

Figure 2A:
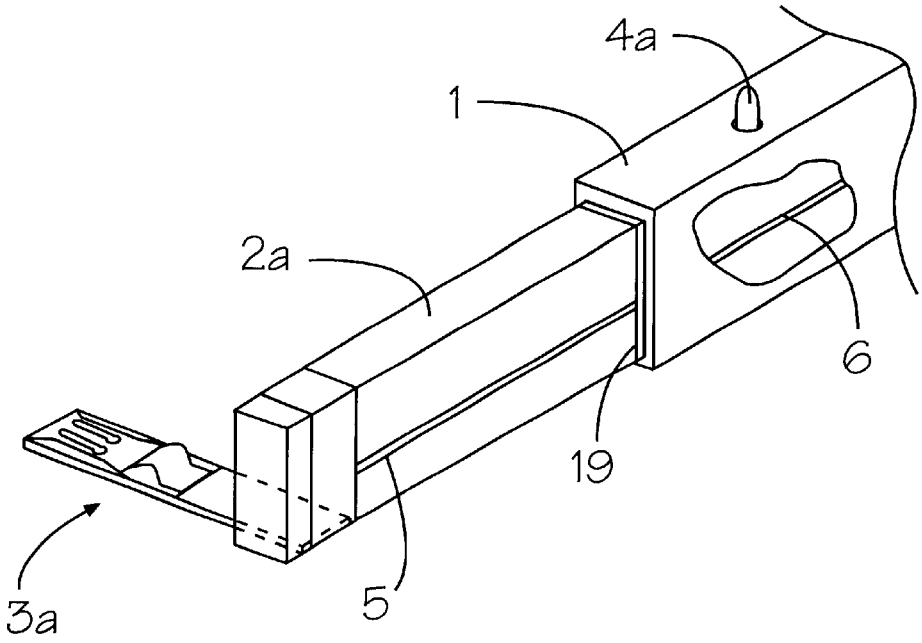
FIG. 2*a* depicts a more detailed partial front view of the roof bracket with its mechanical parts enlarged for view.
Figure 2B:
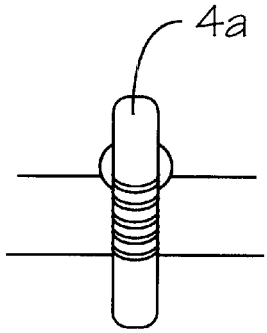
FIG. 2*b* depicts a more detailed view of one of the locking pins.
Figure 2C:
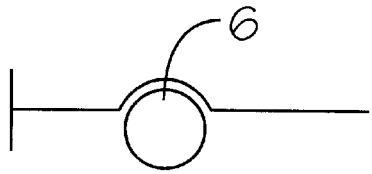
FIG. 2*c* depicts a more detailed view of the bearings.
Figure 3:
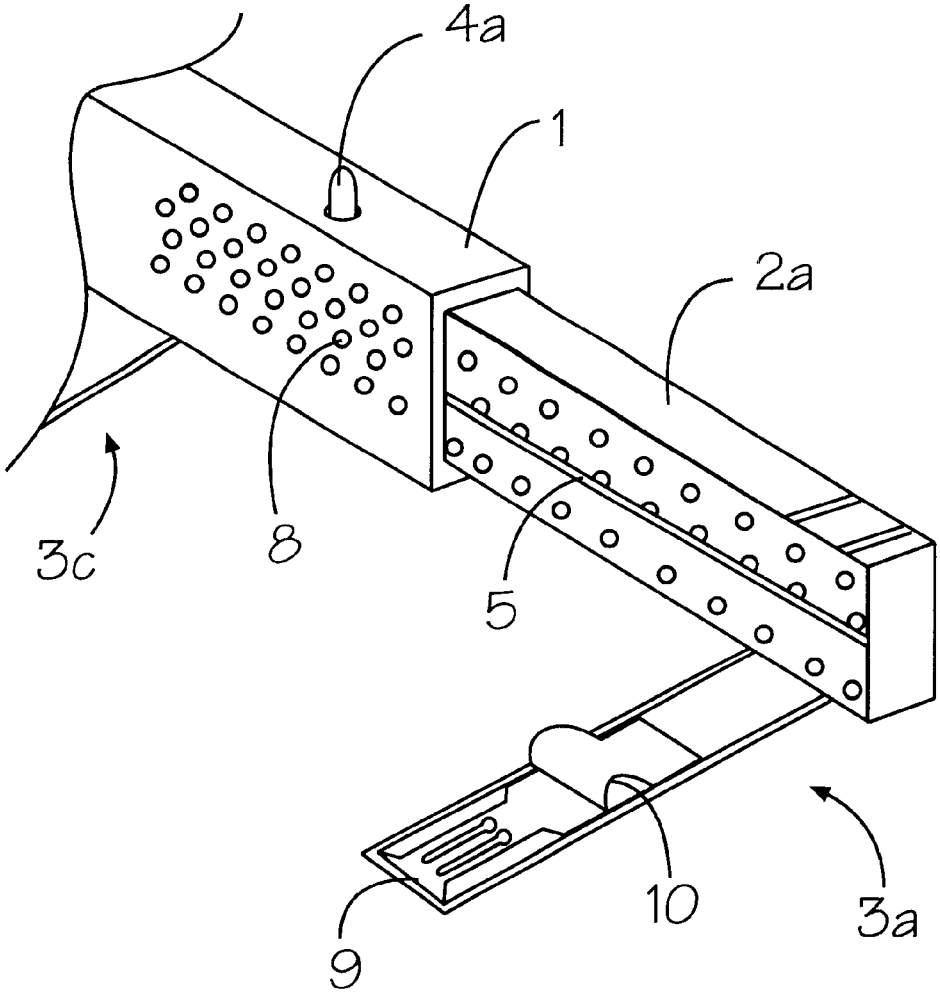
FIG. 3 illustrates a detailed, partial rear view of the roof bracket device depicted in FIG. 1.

Now referring to FIG. 2, bearing glide tracks 5 are grooved to be receptive to bearings 6 to accommodate a smooth extension or shortening of the secondary housings 2*a* and 2*b*. Several safety features have been incorporated within the device 20. Two separate locking pins 4*a* and 4*b*, respectively attached atop and towards the inside end of both secondary housings 2*a* and 2*b* are exposed through the top end of the main housing 1 in the event that either secondary housing 2*a* or 2*b* is extended beyond a marked safety line 19, registered and imprinted upon the outside, inner perimeters of secondary housing 2*a* or 2*b*. The secondary housing 2*a* or 2*b* can neither be extended nor shortened until locking pins 4*a* and 4*b* are depressed inside of main housing 1.

Figure 4:
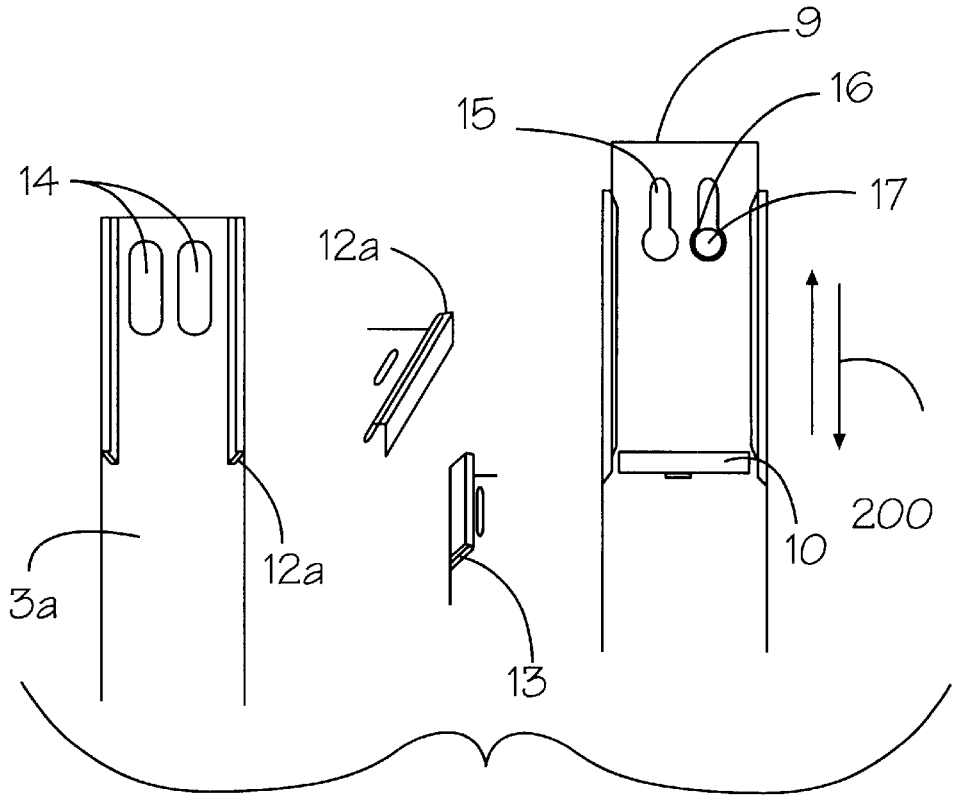
FIG. 4 illustrates a detailed view of the nail lock assembly section of the roof bracket device depicted in FIGS. 3 and 5.
Figure 5:
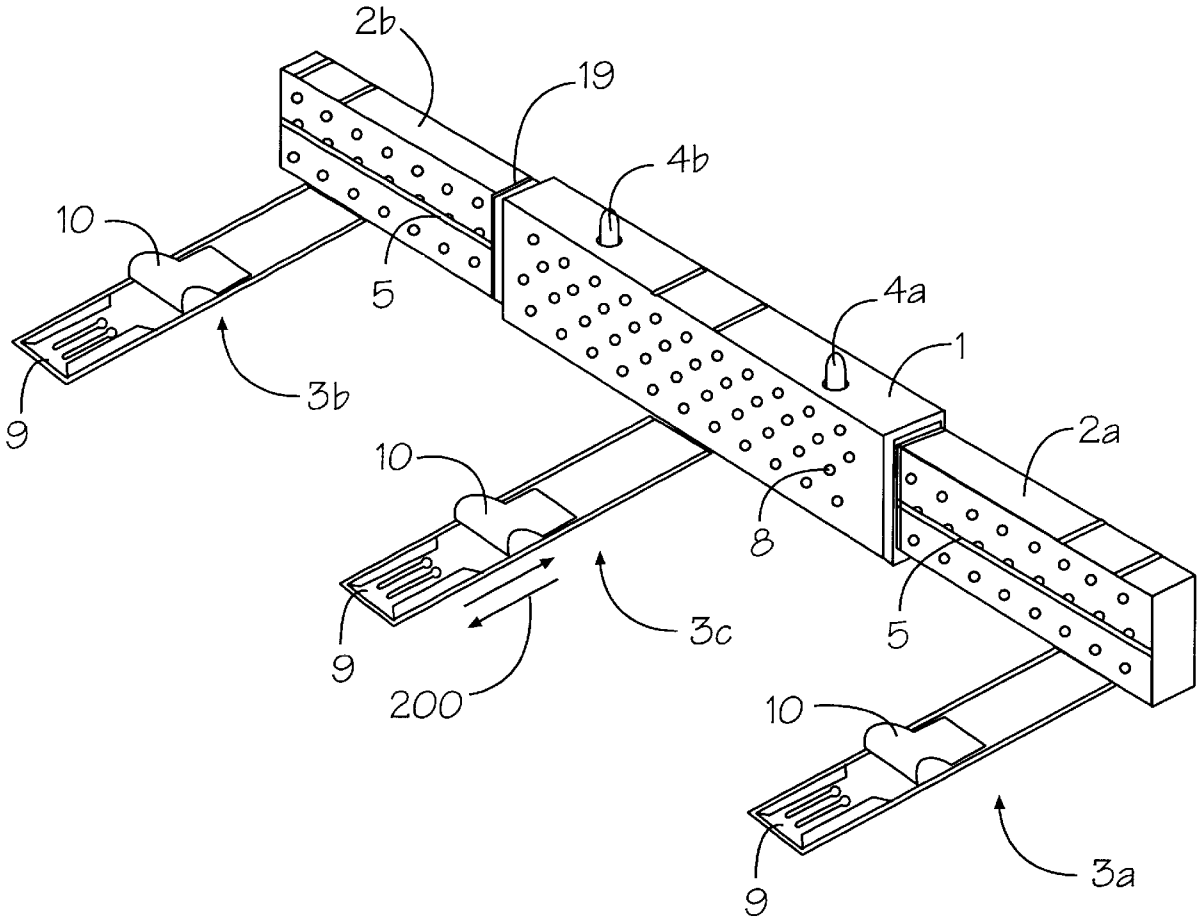
FIG. 5 illustrates an entire back view of the roof bracket device shown in FIG. 1.

A second safety feature is shown in FIG. 4, which illustrates another view of the nail tabs 3*a*, 3*b* and 3*c*. The mechanical and physical properties of the nail tabs 3*a*, 3*b* and 3*c* are identical in nature, although attached in different positions along the length and a back of the device 20 as shown in FIG. 5.

Figure 4A:
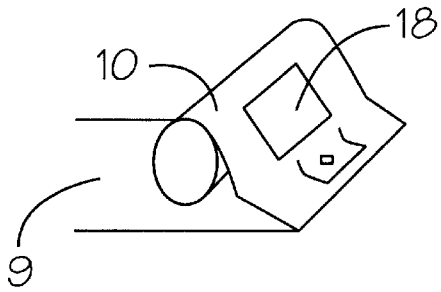
FIG. 4*a* depicts an enlarged view of the sliding lock shoe plate depicted in FIGS. 3 and 5.

FIG. 4*a* is an enlarged view of the bottom end of a sliding lock shoe plate 9 and a shoe plate grip 10, depicted in FIG. 4.

Figure 4B:
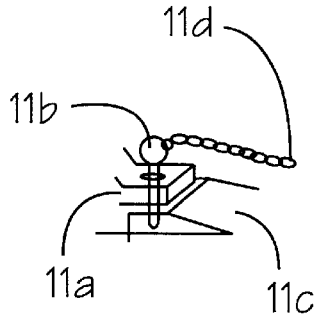
FIG. 4*b* illustrates the safety pin assembly and its mated sections shown in FIG. 4.

FIG. 4*b* shows an enlarged view of a specific section of the sliding lock shoe plate 9 to an area directly behind the shoe plate grip 10 and just below the square strike area 18, depicted in FIG. 4*a*. In FIG. 4*b*, a top clip 11*a*, a pin 11*b* and a bottom base 11*c* are shown. The pin 11*b* end is attached to a chain 11*d* which is secured to the body of nail tab 3*a*. This safety feature is shown engaged. The sliding lock shoe plate 9 movement is restricted.

With the device 20 in its desired position, the nail tab 3*a* depicted in FIG. 4 can be secured upon an inclined surface by lightly snuging nail 17 into both nail slots 16. In this position, the nail tab 3*a* can be temporarily secured or lifted away from nail 17, thereby freeing it from any surface or incline it contacts. In this position, nail slots 16 and tab slots 14 permit the lifting or removal of nail tab 3*a*, because the circumference of nail slots 16 and tab slots 14 are greater than the head size of nail 17. It is the narrowed slots 15, positioned near the top end of the sliding lock shoe plate 9, that actually catches and secures nail 17. To perform this task and secure nail 17, the sliding lock shoe plate 9 must first move to its lowest position.

To adequately perform this operation and allow the sliding lock shoe plate 9 to move in directions of arrows 200, the bottom plate of nail tab 3*a* has a receptive glide track 12*a* positioned to both the top right and left sides of nail tab 3*a*, and mated to receive their counterpart, beveled edges 13. The beveled edges 13 shown in an enlarged view in FIG. 4, are molded respectively to the top right and left sides of the sliding lock shoe plate 9, in effect allowing for the mating of nail tab 3*a* and the sliding lock shoe plate 9. This mating of parts allows for the sliding lock shoe plate 9 to slide either up or down within the defined parameters of glide track 12*a* and within the confines of nail tab 3*a*.

To secure nail tab 3*a* and in its desired position, shoe plate grip 10 is pulled downward, thereby bringing the sliding lock shoe plate 9 downward as well. Pulling the sliding lock shoe plate 9 to its extreme lowest position allows the narrowed slots 15 to gravitate downwardly as well, thus allowing the narrowed slots 15 to snug themselves just beneath the head of nail 17, securing nail tab 3*a* as well. Nail tab 3*a*, as well as the center nail tab 3*c* and the right side nail tab 3*b*, is designed to be secured and released individually by utilizing the sliding lock shoe plate 9, thereby allowing for device 20 removal without distorting its linear properties.

As shown in FIG. 4*a*, and in an enlarged area in FIG. 4*b*, the sliding lock shoe plate 9 has an incorporated safety feature meant to prevent accidental or incidental movement of the sliding lock shoe plate 9 while in its secure position.

In FIG. 4*b*, the sliding lock shoe plate 9 is in its lowest and secure position. The top clip 11*a* and the bottom base 11*c* are held in place by safety pin 11*b*, which traverses through a hole in both the top clip 11*a* and the bottom base 11*c*. Attached to the head of safety pin 11*b* is chain 11*d*, which is secured to the body of nail tab 3*a*, as shown in FIG. 4.

While in this position, the sliding lock shoe plate 9 is in effect locked down, preventing any umwanted movement. To release the sliding lock shoe plate 9 and hence nail tab 3*a*, safe pin 11*b* can be removed and the sliding lock shoe plate 9 pushed up or gently struck upwardly in the square strike area 18.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An adjustable, unitary roofing bracket device, comprising:

a longitudinal, substantially hollow housing having left and right apertures at distal ends thereof for receiving separate secondary housings;

a left secondary housing and a right secondary housing having external dimensions smaller than the internal dimensions of said main housing left and right apertures, respectively;

adjustable means disposed within said main housing for selectively moving each of said left and right secondary housings within said main housing, secondary housings each being extendable from and retractable into said main housing, such that two independent lengths of secondary housing can be extended away from or retracted into said main housing; and anchoring means to a work surface, operatively connected to said main housing and to each of said left and right secondary housings.

2. The adjustable unitary roof bracket device in accordance with claim 1, further comprising means for adjusting a distance of said secondary housings with respect to said main housing.

3. The adjustable unitary roof bracket device in accordance with claim 2, wherein the overall total length of the device can be varied due to the position of each of said housing.

4.The adjustable unitary roof bracket device in accordance with claim 1, further comprising an anchoring lock mechanism and a slidable shoe plate for securing said anchoring means.

5. The adjustable unitary roof bracket device in accordance with claim 4, further comprising an anchoring safety pin having a top clip and bottom base.

6. The adjustable unitary roof bracket device in accordance with claim 4, wherein said main housing comprises a glide track defining a path in which said slidable shoe plate moves.

7. The adjustable unitary roof bracket device in accordance with claim 4, wherein said slidable shoe plate comprises a contoured finger-grip.

8. The adjustable unitary roof bracket device in accordance the claim 1, further comprising a locking pin within each of said secondary housings for restricting over extension thereof.

* * * * *